US008522997B2

(12) United States Patent
Lane et al.

(10) Patent No.: US 8,522,997 B2
(45) Date of Patent: Sep. 3, 2013

(54) STOPPER AND LANYARD LOOP COMBINATION FOR A BEVERAGE CONTAINER

(75) Inventors: Marvin Lane, Round Lake Beach, IL (US); Dwayne Boroski, Lake in the Hills, IL (US); Shawn Young, Algonquin, IL (US)

(73) Assignee: Thermos L.L.C., Schaumburg, IL (US)

( * ) Notice: Subject to any disclaimer, the term of this patent is extended or adjusted under 35 U.S.C. 154(b) by 407 days.

(21) Appl. No.: 12/792,487

(22) Filed: Jun. 2, 2010

(65) Prior Publication Data

US 2011/0297678 A1 Dec. 8, 2011

(51) Int. Cl.
*B65D 55/16* (2006.01)

(52) U.S. Cl.
USPC ..... 220/375; 220/789; 220/826; 220/761

(58) Field of Classification Search
USPC ..... 220/212, 375, 787, 789, 790, 826, 220/836, 843, 849, 846, 761, 762, 396, 768; 206/396
See application file for complete search history.

(56) References Cited

U.S. PATENT DOCUMENTS

| | | | | | |
|---|---|---|---|---|---|
| 235,280 | A | * | 12/1880 | Norton | 220/212.5 |
| 1,289,947 | A | * | 12/1918 | Spengler | 215/301 |
| 2,362,523 | A | * | 11/1944 | Armstrong, Jr. et al. | 215/399 |
| 2,635,604 | A | * | 4/1953 | Fredrickson | 604/403 |
| 3,307,752 | A | * | 3/1967 | Anderson | 222/465.1 |
| 3,386,617 | A | * | 6/1968 | Shankland, Sr. | 220/761 |
| 3,407,956 | A | * | 10/1968 | Linkletter al. | 215/306 |
| 3,441,172 | A | * | 4/1969 | Dike | 220/763 |
| 3,460,701 | A | * | 8/1969 | Powalowski et al. | 215/10 |
| 3,635,367 | A | * | 1/1972 | Morita et al. | 215/399 |
| 3,656,648 | A | * | 4/1972 | Powaloski et al. | 215/253 |
| 3,690,499 | A | * | 9/1972 | Westfall et al. | 215/253 |
| 3,866,782 | A | * | 2/1975 | Westfall | 215/253 |
| 4,101,042 | A | * | 7/1978 | Strong et al. | 215/11.1 |
| 4,282,980 | A | * | 8/1981 | Winchell | 215/399 |
| 4,310,102 | A | * | 1/1982 | Walter | 220/288 |
| 4,345,701 | A | * | 8/1982 | Walter | 222/569 |
| 4,413,741 | A | * | 11/1983 | Curchack | 215/399 |
| 4,460,143 | A | * | 7/1984 | Ohama | 248/682 |
| 4,474,303 | A | * | 10/1984 | Maccise | 220/4.27 |
| 4,592,482 | A | * | 6/1986 | Seager | 220/318 |
| D286,147 | S | * | 10/1986 | Carlson | D12/317 |
| 4,627,550 | A | * | 12/1986 | Dines | 220/270 |

(Continued)

*Primary Examiner* — Anthony Stashick
*Assistant Examiner* — Christopher McKinley
(74) *Attorney, Agent, or Firm* — Wood, Phillips, Katz, Clark & Mortimer

(57) ABSTRACT

A stopper (10) is provided for a beverage container (12) having a fill opening (14) that is closed by the stopper (10). The stopper (10) includes a main body (18), a lid (22), and a rigid lanyard loop (16). The main body (18) is configured for releasable engagement with the opening (14) of beverage container (12) and includes a drinking port (24) to allow a beverage to flow from the beverage container (12) to the mouth of a user. The lid (22) has an upper surface (26) and is hinge mounted to the main body (18) for movement between a closed position wherein the drinking port (24) is covered and an open position wherein the drinking port (24) is exposed for access by a user. The rigid lanyard loop (16) is hinge mounted for movement relative to the lid (22) between a stowed position wherein the lanyard loop (16) extends adjacent the upper surface (26) of the lid (22) and a deployed position wherein the lanyard loop (16) extends away from the upper surface (26) with the lid (22) in the closed position.

12 Claims, 5 Drawing Sheets

(56) References Cited

U.S. PATENT DOCUMENTS

| | | | | | |
|---|---|---|---|---|---|
| 4,728,037 | A | * | 3/1988 | Mainhardt | 239/154 |
| 4,746,027 | A | * | 5/1988 | Coker | 215/293 |
| 4,887,747 | A | * | 12/1989 | Ostrowsky et al. | 222/556 |
| 5,078,291 | A | * | 1/1992 | Gilmour | 215/284 |
| 5,244,113 | A | * | 9/1993 | Stymiest | 220/710.5 |
| 5,269,438 | A | * | 12/1993 | Kelsey | 220/766 |
| 5,325,982 | A | * | 7/1994 | Cobb, Jr. | 220/212.5 |
| 5,339,487 | A | * | 8/1994 | Kasper | 15/246.2 |
| 5,346,099 | A | * | 9/1994 | Salmon et al. | 222/153.06 |
| 5,407,098 | A | * | 4/1995 | Tomer | 222/1 |
| 5,791,505 | A | * | 8/1998 | Gilliland | 215/228 |
| 5,862,929 | A | * | 1/1999 | Takeuchi et al. | 215/398 |
| 6,029,652 | A | * | 2/2000 | Riedl | 126/299 C |
| 6,082,576 | A | * | 7/2000 | Counts-Bradley et al. | 220/787 |
| 6,196,403 | B1 | * | 3/2001 | Yamaguchi | 215/396 |
| 6,364,385 | B1 | * | 4/2002 | Steward et al. | 294/27.1 |
| 6,766,917 | B1 | * | 7/2004 | Blewitt, III | 215/252 |
| 6,880,714 | B2 | * | 4/2005 | Blanchester | 215/399 |
| RE38,816 | E | * | 10/2005 | Baudin | 222/546 |
| D511,457 | S | * | 11/2005 | Biesecker et al. | D9/443 |
| 2002/0084240 | A1 | * | 7/2002 | Yu-Hsien | 215/258 |
| 2002/0084241 | A1 | * | 7/2002 | Yu-Hsien | 215/305 |
| 2006/0255036 | A1 | * | 11/2006 | Chau | 220/254.3 |
| 2008/0245763 | A1 | * | 10/2008 | Chalekian et al. | 215/396 |
| 2008/0308567 | A1 | * | 12/2008 | Counts-Bradley | 220/789 |
| 2009/0165813 | A1 | * | 7/2009 | Sekine | 132/293 |

* cited by examiner

STOPPER AND LANYARD LOOP COMBINATION FOR A BEVERAGE CONTAINER

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

FIELD OF THE INVENTION

This invention relates to stoppers for beverage containers.

BACKGROUND OF THE INVENTION

Stoppers for beverage contains have long been known and are provided in many forms. In some known constructions, the stopper includes a lid that can be manipulated in order to provide access to a drinking port so that a user can drink a beverage from the container without completely removing the stopper or lid. Furthermore, for convenience, it is also known to provide some form of carrying structure, such as a lanyard loop, on such stoppers for increased convenience in carrying the beverage container and/or attaching the beverage container to a backpack, briefcase, belt loop, or such. In some conventional forms, a rigid lanyard loop is provided on the stopper and extends outwardly and upwardly from the stopper, which may work well for its intended purpose, but does increase the overall size of the stopper in combination with the beverage container, which can be an inconvenience in itself.

SUMMARY OF THE INVENTION

In accordance with one feature of the invention, a stopper is provided for a beverage container having a fill opening that is closed by the stopper. The stopper includes a main body, a lid, and a rigid lanyard loop. The main body is configured for releasable engagement with the opening of beverage container and includes a drinking port to allow a beverage to flow from the beverage container to the mouth of a user. The lid has an upper surface and is hinge mounted to the main body for movement between a closed position wherein the drinking port is covered and an open position wherein the drinking port is exposed for access by a user. The rigid lanyard loop is hinge mounted for movement relative to the lid between an stowed position wherein the lanyard loop extends adjacent the upper surface of the lid and a deployed position wherein the lanyard loop extends away from the upper surface with the lid in the closed position.

As one feature, the lanyard loop is moveable with the lid between the closed and open positions with the lanyard in the stowed position.

According to one feature, the lanyard loop is hinge mounted to the main body.

In one feature, the lanyard loop and the lid pivot about a common hinge axis.

As one feature, the lanyard loop and the lid are mounted to a hinge pin carried by the main body.

In one feature, the lanyard loop includes a hinge knuckle receiving the hinge pin.

According to one feature, the lid includes a pair of hinge knuckles receiving the hinge pin.

As one feature, the main body includes a pair of hinge knuckles carrying the hinge pin.

According to one feature, the lanyard loop includes a hinge knuckle receiving the hinge pin, the main body includes a pair of hinge knuckles carrying the hinge pin and spaced on opposite sides of the lanyard loop hinge knuckle, and the lid includes a pair of hinge knuckles receiving the hinge pin and spaced on opposite sides of the main body hinge knuckles that face away from the lanyard loop knuckle.

In one feature, the stopper further includes resilient members sandwiched between the lid hinge knuckles and the main body hinge knuckles. In a further feature, the resilient members are defined by a resilient O-ring that extends between the main body and the lid.

As one feature, the upper surface of the lid is interrupted by a recess that receives the lanyard loop in the stowed position with an upper surface of the lanyard loop being flush with the upper surface of the lid, In one feature, the stopper further includes a resilient member carried by the lid for sealing engagement with the drinking port with the lid in the closed position, the resilient member being compressed between the lid and the main body to provide an opening force that urges the lid from the closed position.

As one feature, the stopper further includes a releasable latch to retain the lid in the closed position.

Other objects, features, and advantages of the invention will become apparent from a review of the entire specification, including the appended claims and drawings.

DETAILED DESCRIPTION OF THE PREFERRED EMBODIMENT

Figure 1A:
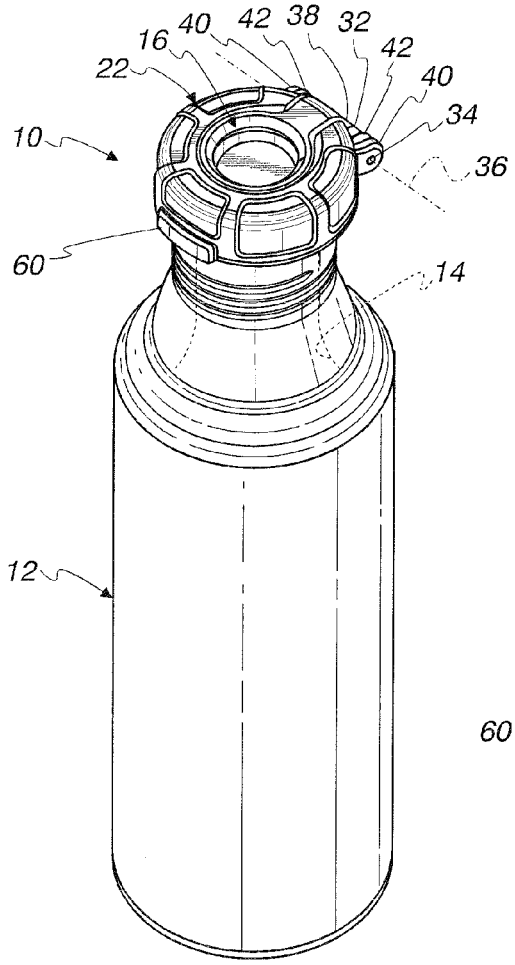
FIGS. 1A and 1B are isometric views from above and to the front showing a stopper embodying the present invention in combination with a beverage container, with FIG. 1A showing a rigid lanyard loop in an undeployed or stowed position and FIG. 1B showing the lanyard loop in a deployed position.
Figure 1B:
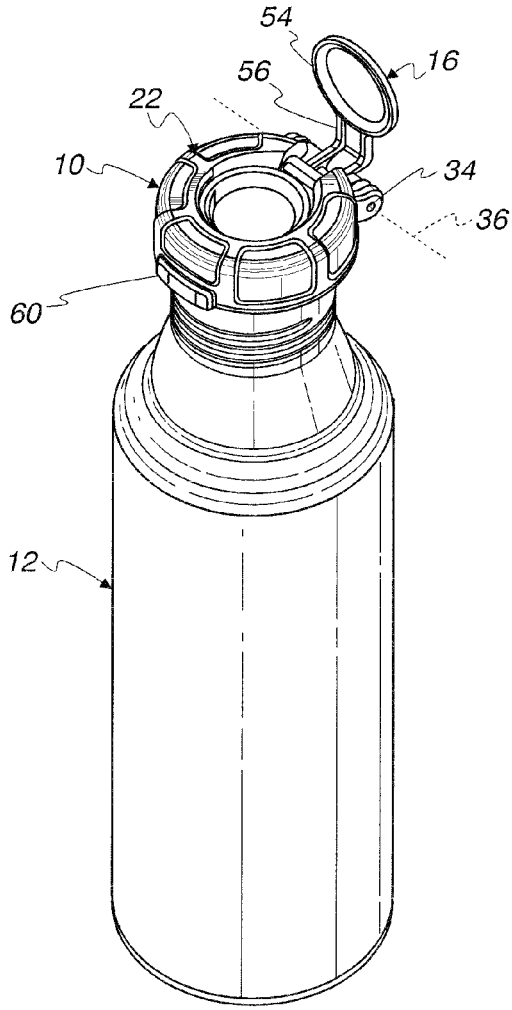

With reference to FIGS. 1A and 1B, a stopper 10 is shown in connection with a beverage container 12 having a fill opening 14 that is closed by the stopper 10. The stopper 10 includes a rigid lanyard loop 16, with the lanyard loop 16 being shown in a stowed or undeployed position in FIG. 1A and in an unstowed or deployed position in FIG. 1B. While one preferred form of beverage container 12 is shown, it should be understood that the invention can be employed with any suitable beverage container having a fill opening that can be closed by a stopper to prevent or restrict leakage of the beverage from the container. This includes insulated and uninsulated beverage containers made from any of a variety of suitable materials, including metallic materials and plastic or composite materials. Because the details of the beverage container 12 are not critical to the invention, they will not be described further herein.

Turning now in more detail to the construction of the stopper 10, as best seen in FIGS. 2-6, the stopper includes a main body 18, a lid 22, and the rigid lanyard loop 16. The main body 18 is configured for releasable engagement with the opening of the beverage container 12 and includes a drinking port 24 (best seen in FIGS. 5C and 6) to allow a beverage to flow from the beverage container to the mouth of a user. The lid 22 is hinge mounted to the main body 18 for movement between a closed position (shown in FIGS. 1A, 1B, 2A, 2B, 3A, 3B, 4A, 4B, 5A and 5B) wherein the drinking port 24 is covered and an open position (shown in FIGS. 2C, 3C, 4C and 5C wherein the drinking port 24 is exposed for access by a user. The lanyard loop 16 is hinge mounted for movement relative to the lid 22 between the stowed position (shown in FIGS. 1A, 2A, 2C, 3A, 3C, 4A, 4C, 5A and 5C) wherein the lanyard loop 16 extends adjacent an upper surface 26 of the lid 22 and the deployed position (shown in FIGS. 1B, 2B, 3B, 4B and 5B) wherein the lanyard loop 16 extends away from the upper surface 28 with the lid 22 in the closed position. In this regard, preferably the upper surface 26 of the lid 22 is interrupted by a recess 28 (best seen in FIGS. 5A and 5B) that receives the lanyard loop 16 in the stowed position, with an upper surface 30 of the lanyard loop 16 being flush with the upper surface 26 of the lid 22.

Figure 2A:
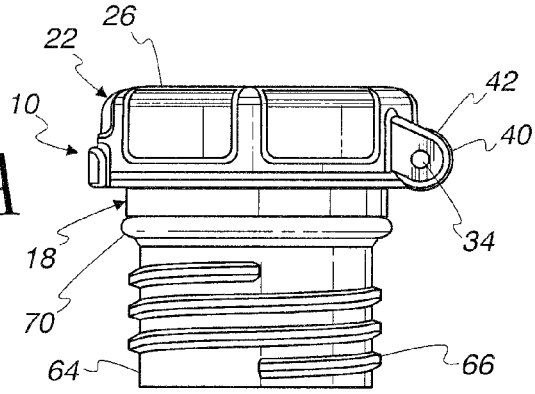
FIGS. 2A, 2B and 2C are right side elevation views of the stopper of FIGS. 1A and 1B, with FIG. 2A showing the lanyard loop in the stowed position and a lid of the stopper in a closed position, FIG. 2B showing the lanyard loop in the deployed position and the lid in the closed position, and FIG. 2C showing the lanyard loop in the stowed position and the lid in an open position.
Figure 2B:
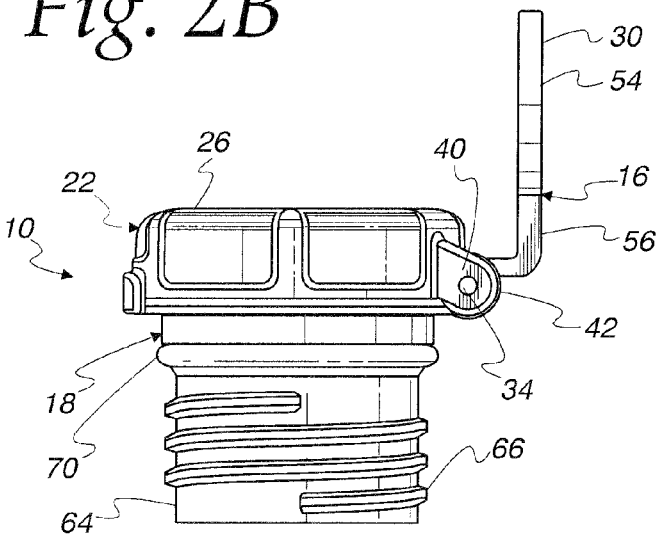
Figure 2C:
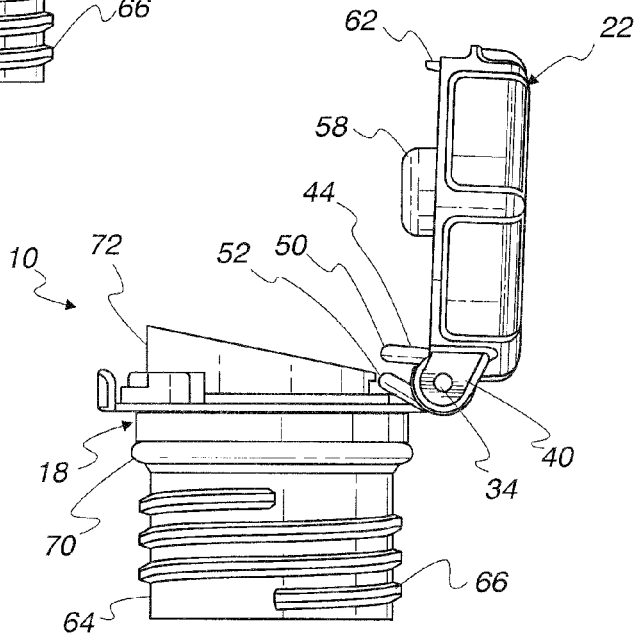
Figure 3A:
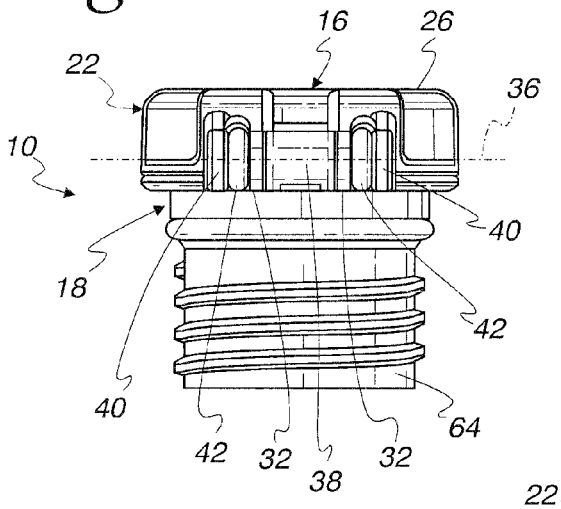
FIGS. 3A, 3B and 3C are back views of the stopper, with FIG. 3A showing the lanyard loop in the stowed position and the lid in the closed position, FIG. 3B showing the lanyard loop in the deployed position and the lid in the closed position, and FIG. 3C showing the lanyard loop in the stowed position and the lid in the open position.
Figure 3B:
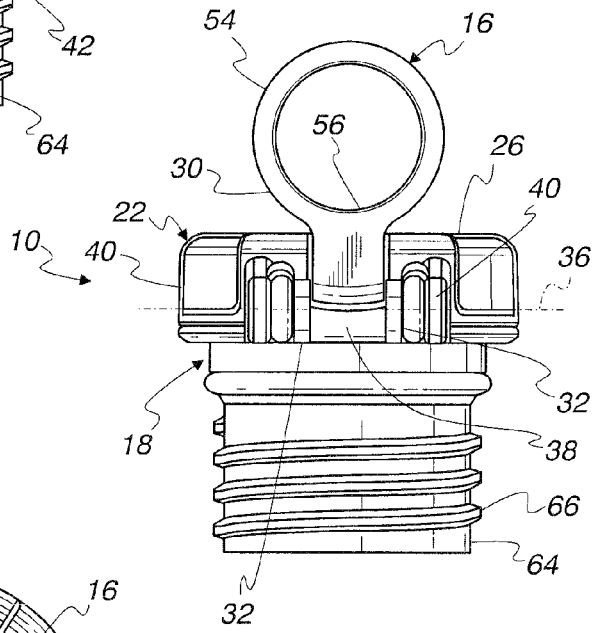
Figure 3C:
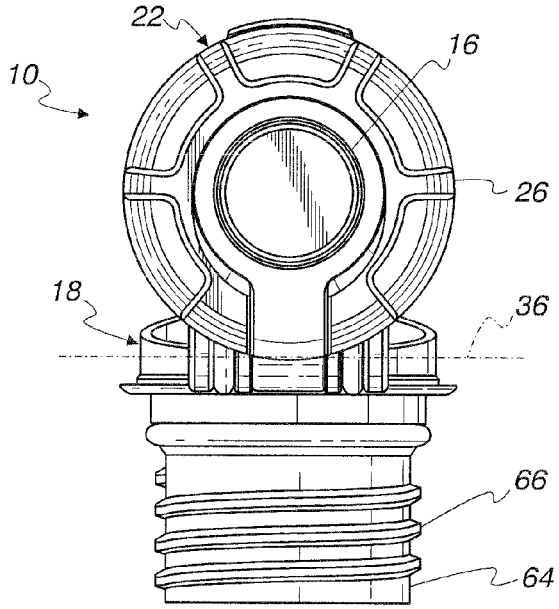
Figure 4A:
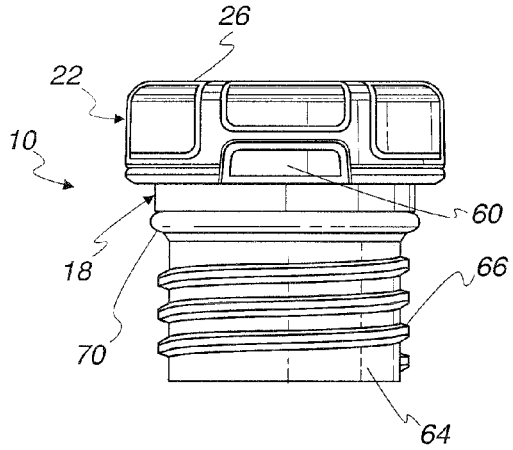
FIGS. 4A, 4B and 4C are front views of the stopper, with FIG. 4A showing the lanyard loop in the stowed position and the lid in the closed position, FIG. 4B showing the lanyard loop in the deployed position and the lid in the closed position, and FIG. 4C showing the lanyard loop in the stowed position and the lid in the open position.
Figure 4B:
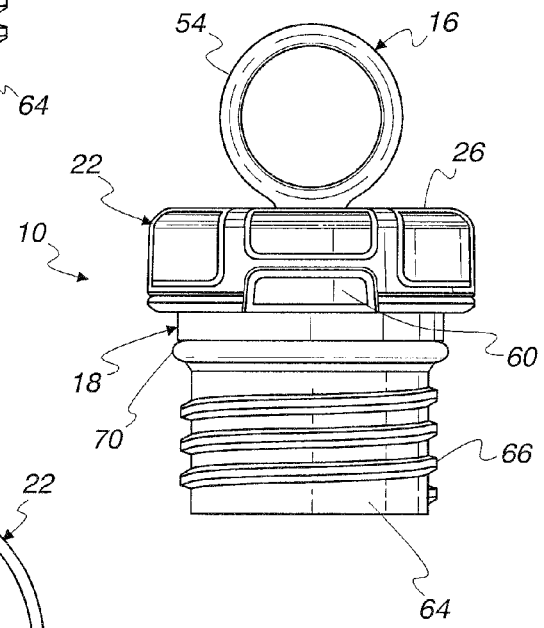
Figure 4C:
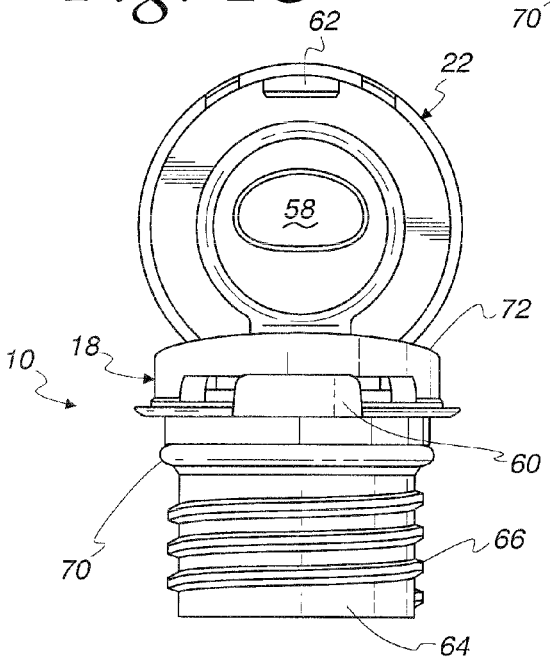

With respect to the hinge mounting of the lid 22 and the lanyard loop 16, the main body 18 includes a pair of hinge knuckles 32 that carry a hinge pin 34 that defines a transversely extending hinge axis 36. The lanyard loop 16 includes a hinge knuckle 38 receiving the hinge pin 34 and located between the hinge knuckles 32 of the main body 18. The lid 22 includes a pair of hinge knuckles 40 receiving the hinge pin 34 and spaced on opposite sides of the hinge knuckles 32 that face away from the lanyard loop knuckle 38. Preferably, a pair of resilient members 42 are sandwiched between the hinge knuckles 40 of the lid 22 and the hinge knuckles 32 of the main body 18. In this regard, a resilient O-ring 44 is looped around the hinge pin 34 at two locations to define the resilient members 42, with two parallel lengths 50 and 52 of the O-ring 44 extending between the main body 18 and the lid 22, as best seen in FIG. 2C.

The lanyard loop 16 includes a ring 54 that is preferably sized to receive a finger of a user and/or an attachment clip or carabiner, and a shank or leg 56 that connects the ring 54 to the hinge knuckle 38.

The lid 22 preferably carries a resilient member 58 for sealing engagement with the drinking port 24, with the lid 22 in the closed position. The resilient member 58 preferably has a cross-sectional shape that conforms to, but is slightly larger than the cross-sectional shape of the drinking port 24. The resilient member 58 is compressed between the lid 22 and the main body 18 to provide an opening force that urges the lid 22 from the closed position. In this regard, a spring loaded latch 60 is mounted on the main body 18 for transverse translational motion so as to be selectively engageable and disengageable with a catch 62 provided on the lid 22, with engagement of the latch 60 and the catch serving to retain the lid 22 in the closed position and actuation of the latch 60 by a user serving to disengage the catch 62 and allow the lid 22 to be moved to the open position. It should be appreciated that while a preferred form of the latch 60 is shown, in some applications other forms of latches can be used, many of which are known.

Figure 5A:
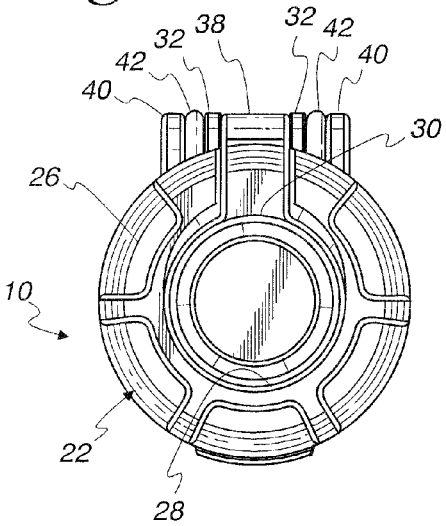
FIGS. 5A, 5B and 5C are top plan views of the stopper, with FIG. 5A showing the lanyard loop in the stowed position and the lid in the closed position, FIG. 5B showing the lanyard loop in the deployed position and the lid in the closed position, and FIG. 5C showing the lanyard loop in the stowed position and the lid in the open position.
Figure 5B:
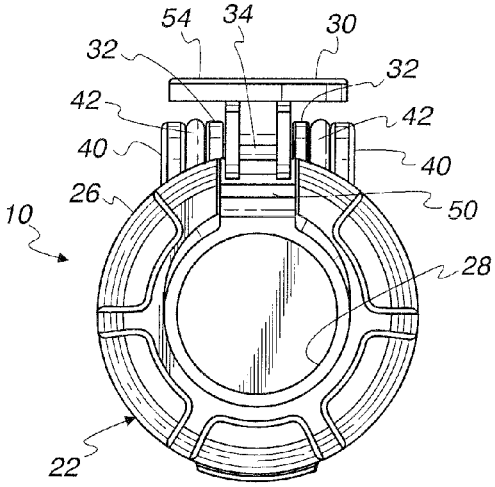
Figure 5C:
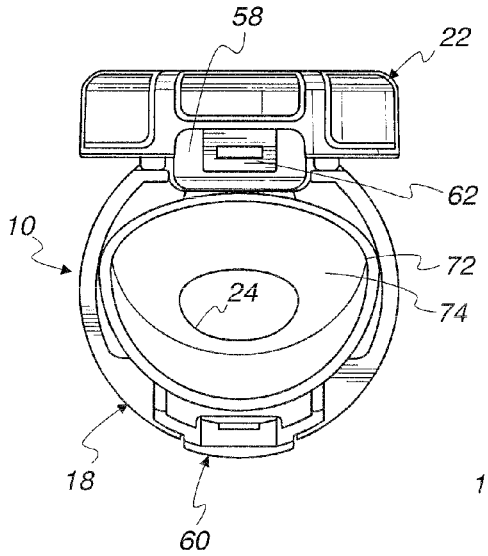
Figure 6:
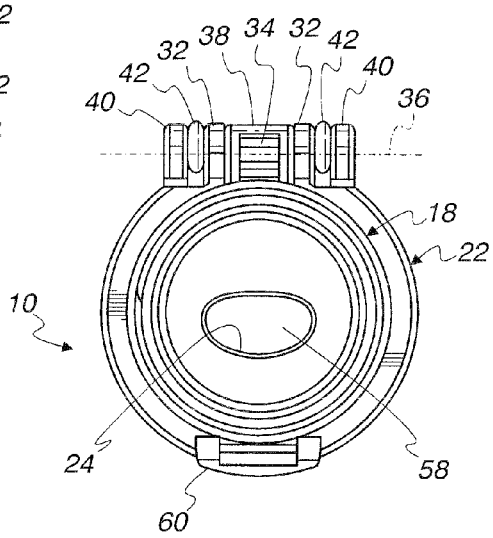
FIG. 6 is a bottom plan view of the stopper with the lanyard loop in the stowed position and the lid in the closed position.

Preferably, the main body 18 includes a longitudinally extending skirt 64 that is sized and configured for engagement with the opening 14 of the beverage container 12. In the illustrated embodiment, the skirt 64 is sized to fit within the opening 14 and includes male threads 66 for engagement with female threads formed in the opening 14 of the beverage container 12. A resilient O-ring seal 70 is also carried on an O-ring gland provided on the skirt in the illustrated embodiment for sealing engagement with the opening 14. It should be appreciated that in some applications, depending upon the construction of the beverage container, the skirt 64 may be engageable with an exterior side of the opening 14 of the beverage container 12 and may include other types of releasable fasteners, such as a snap fastener. Furthermore, it should be appreciated that in some embodiments, a seal or gasket may be carried on the beverage container 12, in which case there would be no need for a resilient O-ring seal or gasket on the skirt 18. Preferably, as best seen in FIG. 5C, the main body 18 also includes a drinking lip 72 that surrounds a recess 74 in which the drinking port 24 is located. It should be appreciated that depending upon the application, the drinking lip 72 and the recess 74 can take on many different forms, including having one or both eliminated.

Any suitable rigid structural materials, including plastic and metal, can be used to form the components 16, 18, 22, and 34, with one preferred construction for the components 16, 18 and 22 being injection molded plastic or composite. Any suitable resilient materials, such a silicon rubber, can be used to form the components 42, 44, 58, and 70.

While a preferred embodiment of the lid 10 has been shown, it should be appreciated that modifications to general geometric shapes, relative locations, and such are possible within the scope of the invention. For example, although the lid 22 and ring 54 are shown to have generally circular configurations, other geometric shapes are possible depending upon the desires of each application. As another example, while the drinking port 24 is shown as having a somewhat oval shape, other geometric shapes are possible. As yet another example, while it is preferred for the upper surface 26 to include the recess 28 for flush mounting of the lanyard loop 16, in some applications, the recess 28 may not be desired and the lanyard loop 16 may lay on top of the surface 26. As yet another example, while the lanyard loop 16 is shown as being hinge mounted to the main body 18; in some applications it may be desirable to hinge mount the lanyard loop onto the lid

22. As yet a further example, while a certain number of hinge knuckles have been shown on each of the different components 16, 18, and 22, other numbers and combinations of hinge knuckles may be desired depending upon the particular application. As yet a further example, while the resilient members 42 and 58 are preferred, in some applications one or both may not be desirable.

It should be appreciated that the provision of the rigid lanyard loop 16 on the stopper 18 for movement between stowed and deployed positions allows for the stopper 18 to provide the convenience of a lanyard loop 16, without the inconvenience of having the lanyard loop 16 always extend upwardly and away from the stopper 18.

The invention claimed is:

1. A stopper for a beverage container having a fill opening that is closed by the stopper, the stopper comprising;

a main body that is configured for releasable engagement with the opening of beverage container, the main body including a drinking port to allow a beverage to flow from the beverage container to the mouth of a user;

a lid hinge mounted to the main body for movement between a closed position wherein the drinking port is covered and an open position wherein the drinking port is exposed for access by a user, the lid having an upper surface; and a rigid lanyand loop hinge mounted for movement relative to the lid between a stowed position wherein the lanyard loop extends adjacent the upper surface of the lid and a deployed position wherein the lanyard loop extends away from the upper surface with the lid in the closed position;

wherein the lanyard loop is moveable with the lid between the closed and open positions with the lanyard loop in the stowed position.

2. A stopper for a beverage container having a fill opening that is closed by the stopper, the stopper comprising:

a main body that is configured for releasable engagement with the opening of beverage container, the main body including a drinking port to allow a beverage to flow from the beverage container to the mouth of a user;

a lid hinge mounted to the main body for movement between a closed position wherein the drinking port is covered and an open position wherein the drinking port is exposed for access by a user, the lid having an upper surface; and a rigid lanyard loop hinge mounted for movement relative to the lid between a stowed position wherein the lanyard loop extends adjacent the upper surface of the lid and a deployed position wherein the lanyard loop extends away from the upper surface with the lid in the closed position;

wherein the lanyard loop and the lid pivot about a common hinge axis.

3. A stopper for a beverage container having a fill opening that is closed by the stopper, the stopper comprising:

a main body that is configured for releasable engagement with the opening of beverage container, the main body including a drinking port to allow a beverage to flow from the beverage container to the mouth of a user;

a lid hinge mounted to the main body for movement between a closed position wherein the drinking port is covered and an open position wherein the drinking port is exposed for access by a user, the lid having an upper surface; and a rigid lanyard loop hinge mounted for movement relative to the lid between a stowed position wherein the lanyard loop extends adjacent the upper surface of the lid and a deployed position wherein the lanyard boo extends away from the upper surface with the lid in the closed position;

wherein the lanyard loop and the lid are mounted to a hinge pin carried by the main body.

4. The stopper of claim 3 wherein the lanyard loop comprises a hinge knuckle receiving the hinge pin.

5. The stopper of claim 3 wherein the lid comprises a pair of hinge knuckles receiving the hinge pin.

6. The stopper of claim 3 wherein the main body includes a pair of hinge knuckles carrying the hinge pin.

7. The stopper of claim 3 wherein the lanyard loop comprises a hinge knuckle receiving the hinge pin, the main body comprises a pair of hinge knuckles carrying the hinge pin and spaced on opposite sides of the lanyard loop hinge knuckle, and the lid comprises a pair of hinge knuckles receiving the hinge pin and spaced on opposite sides of the main body hinge knuckles that face away from the lanyard loop knuckle.

8. The stopper of claim 7 further comprising resilient members sandwiched between the lid hinge knuckles and the main body hinge knuckles.

9. The stopper of claim 8 wherein the resilient members are defined by a resilient O-ring that extends between the main body and the lid.

10. A stopper for a beverage container having a fill opening that is closed by the stopper, the stopper comprising:

a main body that is configured for releasable engagement with the opening of beverage container, the main body including a drinking port to allow a beverage to flow from the beverage container to the mouth of a user;

a lid hinge mounted to the main body for movement between a closed position wherein the drinking port is covered and an open position wherein the drinking port is exposed for access by a user, the lid having an upper surface; and a rigid lanyard loop hinge mounted for movement relative to the lid between a stowed position wherein the lanyard loop extends adjacent the upper surface of the lid and a deployed position wherein the lanyard loop extends away from the upper surface with the lid in the closed position;

wherein the upper surface of the lid is interrupted by a recess that receives the lanyard loop in the stowed position with an upper surface of the lanyard loop being flush with the upper surface of the lid.

11. The stopper of claim 1 further comprising a resilient member carried by the lid for sealing engagement with the drinking port with the lid in the closed position, the resilient member being compressed between the lid and the main body to provide an opening farce that urges the lid from the closed position.

12. The stopper of claim 11 further comprising a releasable latch to retain the lid in the closed position.

* * * * *

UNITED STATES PATENT AND TRADEMARK OFFICE

CERTIFICATE OF CORRECTION

PATENT NO. : 8,522,997 B2
APPLICATION NO. : 12/792487
DATED : September 3, 2013
INVENTOR(S) : Marvin Lane et al.

It is certified that error appears in the above-identified patent and that said Letters Patent is hereby corrected as shown below:

In the Claims

Claim 3 (column 6, line 7), delete "boo" and substitute therefor "loop".

Claim 11 (column 6, line 55), delete "farce" and substitute therefor "force".

Signed and Sealed this
Twenty-first Day of April, 2015

Michelle K. Lee

Michelle K. Lee
*Director of the United States Patent and Trademark Office*